US006161554A

United States Patent [19]

Dunlap-Harris

[11] Patent Number: 6,161,554

[45] Date of Patent: Dec. 19, 2000

[54] REMOVABLE TATTOO EYEBROWS

[76] Inventor: Angela L. Dunlap-Harris, 71 Westervelt Pl., Teaneck, N.J. 07666

[21] Appl. No.: 09/437,442

[22] Filed: Nov. 10, 1999

Related U.S. Application Data

[60] Provisional application No. 60/107,968, Nov. 12, 1998.

[51] Int. Cl.[7] ..... A45D 40/30; A45D 40/26

[52] U.S. Cl. ..... 132/216; 132/218; 132/319

[58] Field of Search ..... 132/216, 218, 132/215, 285, 319; 428/500, 42, 914, 402, 40, 43

[56] References Cited

U.S. PATENT DOCUMENTS

| | | | |
|---|---|---|---|
| 2,628,626 | 2/1953 | Teillaud | 132/88.5 |
| 2,842,142 | 7/1958 | Peck | 132/216 |
| 2,917,058 | 12/1959 | Ferrar | 132/216 |
| 4,118,870 | 10/1978 | Dyson | 33/174 D |
| 4,858,631 | 8/1989 | Chuang | 132/218 |
| 4,936,325 | 6/1990 | Davis | 132/319 |
| 5,015,263 | 5/1991 | Albrecht et al. | 8/680 |
| 5,052,418 | 10/1991 | Miller | 132/319 |
| 5,421,765 | 6/1995 | Lehmann et al. | 446/296 |
| 5,470,351 | 11/1995 | Ross et al. | 607/95 |
| 5,578,353 | 11/1996 | Drew | 428/43 |
| 5,662,129 | 9/1997 | Grenevitch et al. | 132/319 |
| 5,860,433 | 1/1999 | Halpern | 132/319 |
| 5,928,797 | 7/1999 | Vineberg | 428/500 |

*Primary Examiner*—John J. Wilson
*Assistant Examiner*—Robyn Kieu Doan
*Attorney, Agent, or Firm*—Richard C. Litman

[57] ABSTRACT

Aesthetically attractive, moisture activated, removable tattoo eyebrows for the cosmetic enhancement of a human face where eyebrows are usually present. The removable tattoo eyebrows are temporary, simulated eyebrows composed of a moisture activated transferable colorant material, preferably located on a sheet of plastic, cloth or paper. The removable tattoo eyebrows come in various designs, sizes, shapes and/or colors. The removable tattoo eyebrows can be quickly and easily transferred onto a human face, by placing the sheet containing the tattoo up against the eyebrow region of the face, and applying moisture from a damp cloth or sponge.

4 Claims, 3 Drawing Sheets

REMOVABLE TATTOO EYEBROWS

CROSS-REFERENCE TO RELATED APPLICATION

This application claims the benefit of U.S. Provisional Patent Application Ser. No. 60/107,968, filed Nov. 12, 1998.

BACKGROUND OF THE INVENTION

1. Field of the Invention

The present invention relates to the field of cosmetic simulated eyebrows, particularly, transferably moisture activated, temporary, removable tattoo eyebrows.

2. Description of the Related Art

It has been a common practice among some individuals, particularly women, to enhance their visible beauty and attractiveness by simulating and/or augmenting the appearance of their eyebrows with the use of an eyebrow pencil or the like. However, it is difficult to paint or draw both eyebrows identically, but oppositely, with an eyebrow pencil and as a result, one eyebrow may be differently sized and/or shaped from the other. The resulting unsymmetrical simulated eyebrows may not be aesthetically attractive or desirable.

In an attempt to overcome these drawbacks, various approaches have been developed to facilitate the application and formation of symmetrical, shapely and aesthetically attractive simulated or augmented eyebrows. One solution for overcoming the disadvantages inherently associated with drawing simulated eyebrows are permanent tattoo eyebrows. However, permanent tattoo eyebrows represent a rather extreme and permanent act that greatly diminishes the alternatives the tattooed individual has in terms of changing or removing the resulting permanently tattooed eyebrow. Besides, permanent tattoos are costly, painful to have applied, require the use of needles to inject non-fugitive dyes and pigments beneath the skin to form the desired eyebrow, require a recovery time, and carry risks that can lead to a variety of infections, some of which may be life threatening. Therefore, permanent tattoo eyebrows are not a practical or realistic option for enhancing one's appearance.

Other approaches known in the art for facilitating the drawing or painting of symmetrical and shapely simulated eyebrows onto a users face include the use of various stencils, templates and/or guiding devices. Examples of such approaches are taught in U.S. Pat. No. 2,628,626 issued on Oct. 23, 1958 to Teillaud; U.S. Pat. No. 4,118,870 issued on Oct. 10, 1978 to Dyson; and U.S. Pat. No. 5,662,129 issued on Sep. 2, 1997 to Greenevitch et al.

Another approach is taught in U.S. Pat. No. 4,858,631 issued on Aug. 22, 1989 to Chuang which discloses simulated eyebrows located on an applicator. The applicator is adhesively attached to a user's face, and the simulated eyebrows are transferred from the applicator to the user's face by applying pressure evenly and consistently, with a finger, while rubbing over the back of the applicator. However, the simulated eyebrows disclosed in Chuang apparently may not adequately adhere to a user's face because of the compositional makeup of the simulated eyebrows, as well as the manner in which the simulated eyebrows are transferred onto a user's face, particularly if the user fails to thoroughly apply pressure evenly and consistently while rubbing. If the entire portion of the simulated eyebrows are not rubbed evenly and consistently, the result will be a poorly bonded simulated eyebrow. Inadequate adherence can be further exacerbated by the inherent unevenness and/or softness associated with that portion of the human face where eyebrows are usually located.

The present invention avoids these drawbacks by using moisture activated removable tattoo eyebrows that are transferred onto a user's face by moisture delivered to the backside of a moisture permeable sheet carrying the tattoo. Since the present moisture activated tattoo eyebrows are not dependent upon the application of pressure consistently and evenly applied while rubbing, they are not susceptible to the deficiencies associated with this method of transfer. Thus, a need exists for easy to use, transferably moisture activated, temporary and removable tattoo eyebrows that do not posses the disadvantages associated with the cosmetic simulated eyebrows previously known in the art.

None of the above inventions and patents, taken either singly or in combination, are seen to describe the instant invention as claimed.

SUMMARY OF THE INVENTION

Accordingly, it is a principal object of the present invention to provide aesthetically attractive, transferably moisture activated, removable tattoo eyebrows for cosmetic enhancement of the human face. The removable tattoo eyebrows are temporary simulated eyebrows composed of a moisture activated transferable colorant, located on a sheet preferably of plastic, cloth, paper or a combination thereof. The removable tattoo eyebrows come in various designs, sizes, shapes and/or colors, and can be quickly and easily transferred onto a human face, above the eyes, where eyebrows are usually present.

It is another object of the present invention to provide transferably moisture activated removable tattoo eyebrows that can be applied to a human face without the use of an eyebrow pencil, crayon, brush, template, stencil or the like.

It is a further object of the present invention to provide transferably moisture activated removable tattoo eyebrows having various designs, shapes, sizes and/or colors, that can be used to extend, augment or replace existing eyebrows.

Still another object of the present invention is to provide a quick and easy method of applying transferably moisture activated removable tattoo eyebrows onto a human face, above the eyes, where the eyebrows are usually present.

It is an object of the present invention to provide aesthetically attractive, transferably moisture activated, temporary and removable tattoo eyebrows for the purposes described, which are inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to transferably moisture activated, removable tattoo eyebrows for cosmetic enhancement of the human face, and a method of applying the same, to a region of the human face where eyebrows are usually present.

The expression "transferably moisture activated", as used herein, means a tattoo eyebrow that is readily transferable from a moisture permeable transfer sheet that carries the tattoo onto a human face, above the eyes where eyebrows are usually present; by the application of moisture or water as delivered by a sponge, cloth or the like, to the side of the moisture permeable sheet opposite the side the tattoo is located.

The side of the moisture permeable transfer sheet where moisture or water is to be applied, will also be referred to as the "back" or "rear" side. The side of the moisture permeable transfer sheet where the tattoo eyebrow is located will be referred to as the "front" side.

The terms "removable" and "temporary", as used herein, refer to the ability of the tattoo eyebrows to be wiped off or removed from the skin on which they have been applied, such as by normal washing with water, conventual soaps, make-up or cosmetic removal compositions, alcohol, and the like. The instantly disclosed removable tattoos can be contrasted with permanent tattoos which cannot be wiped off or removed by washing, and can only be removed by medical intervention or the like, such as by surgical means.

Figure 1:
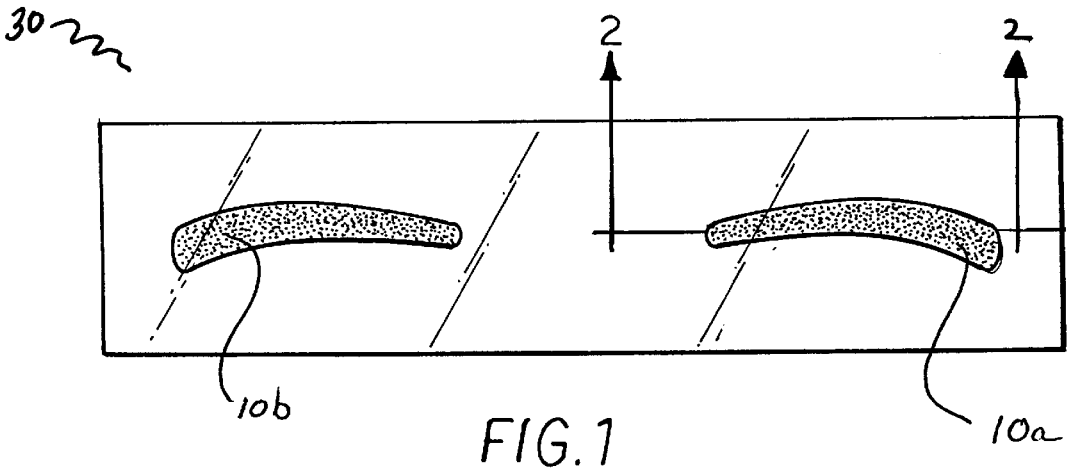
FIG. 1 is an elevational view of a removable tattoo eyebrow carrier sheet according to the present invention.
Figure 2:
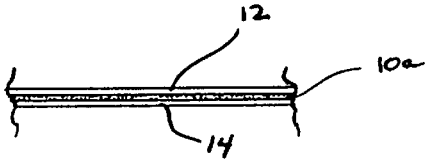
FIG. 2 is a cross sectional view of the tattoo eyebrow carrier sheet shown in FIG. 1 taken along lines 2—2.
Figure 3:
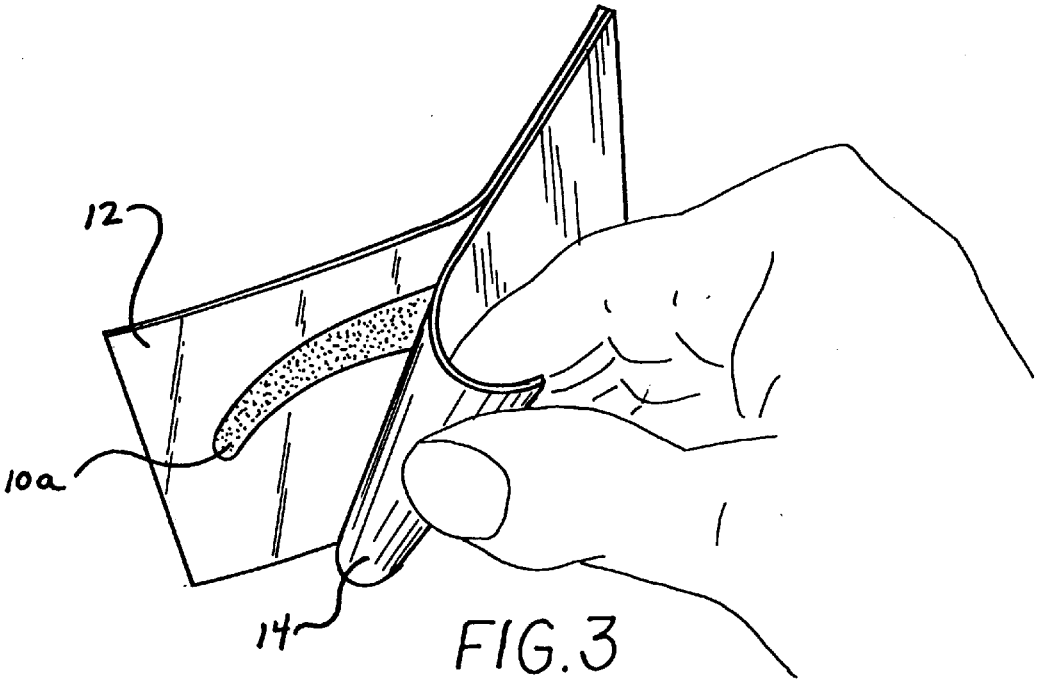
FIG. 3 is a perspective view demonstrating the manner in which a protective release layer is peeled back from the remaining tattoo eyebrow carrier sheet in order to be removed.

FIGS. 1–3 of the drawings depict a removable tattoo eyebrow carrier sheet 30 having a water permeable transfer sheet 12, a pair of tattoo eyebrows (10*a*, 10*b*) provided thereon, and a protective release sheet 14. The protective release sheet 14 must be peeled off and separated from the remainder of the tattoo eyebrow carrier sheet 30 prior to the application of the tattoo, onto a face. The water permeable transfer sheet 12 and protective release sheet 14 are preferably transparent or translucent sheets composed of flexible paper, plastic, cloth or combination of thereof. The transparency or translucency of the water permeable transfer sheet 12, and the protective release sheet 14, should be such that the user can easily discern the eyebrow tattoo through either sheet, in order to facilitate the correct placement and the like, of the eyebrow tattoo upon the face.

The water permeable transfer sheet 12 is preferably of a material that allows for moisture or water to pass from the back side of the sheet to the front side of the sheet, in order to allow the eyebrow tattoo to be transferably moisture activated to adhere onto a users's face.

The protective release sheet 14 is preferably of a material that allows for ready separation of the protective release sheet, from the remainder of carrier sheet 30, such that the eyebrow tattoo remains adhered to the water permeable transfer sheet 12, and not adhered to the protective release sheet 14.

The tattoo eyebrows (10*a*, 10*b*) are located on the water permeable transfer sheet 12, and can comprise a dye, ink, colorant, pigment or the like. The tattoo eyebrows (10*a*, 10*b*) preferably consist of a hypoallergenic water soluble, vegetable dye or ink that is capable of being transferably moisture activated to adhere onto a users's face, upon the application of moisture to the back of the water permeable transfer sheet 12. While the eyebrow tattoos are shown as a pair in FIG. 1, each eyebrow is preferably applied one at a time. Preferably, the eyebrow pair can be separated form one another such as by tearing or cutting the carrier sheet 30 in half. Alternatively, the carrier sheet 30 containing a pair of tattoo eyebrows can be perforated, or the like, preferably down the middle of the sheet and between the two eyebrows, in order to facilitate the tearing of the carrier sheet 30 at the perforation.

FIG. 3 of the drawings depicts the peeling back of the protective release layer 14 from the remainder of tattoo eyebrow carrier sheet 30 in order to remove the protective release layer 14, and thereby expose the eyebrow tattoo 10*a*. The carrier sheet, now consisting of only the water permeable transfer sheet 12 and the eyebrow tattoo 10*a*, is now ready to permit the transfer of the eyebrow tattoo 10*a* onto a user's face 20.

Figure 4:
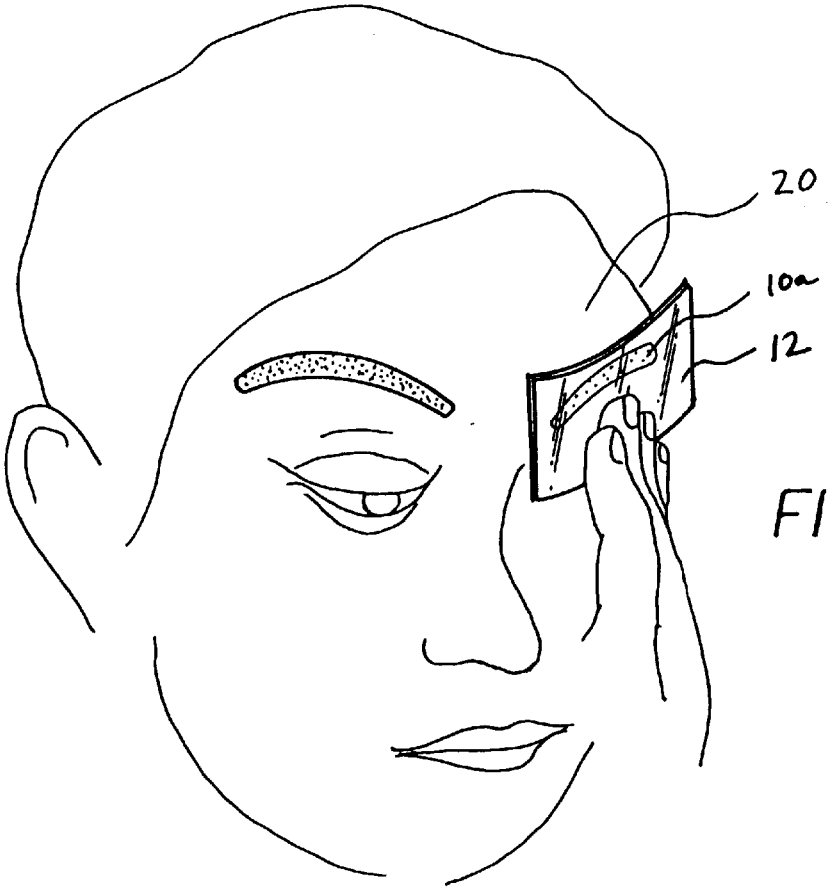
FIG. 4 is an illustrative environmental perspective of the tattoo eyebrow carrier sheet, less the removed protective release layer, placed above a user's left eye, where an eyebrow is usually present.
Figure 5:
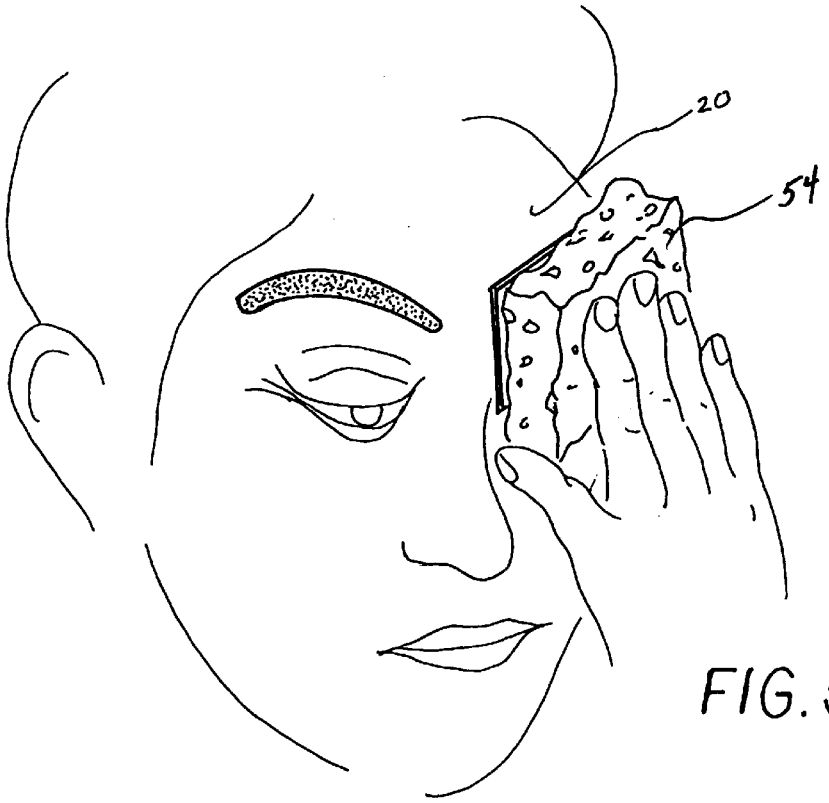
FIG. 5 is a view similar to FIG. 4, showing a moistened sponge placed against the rear of a moisture permeable transfer sheet in order to transfer the tattoo eyebrow onto the user's face, above the left eye.
Figure 6:
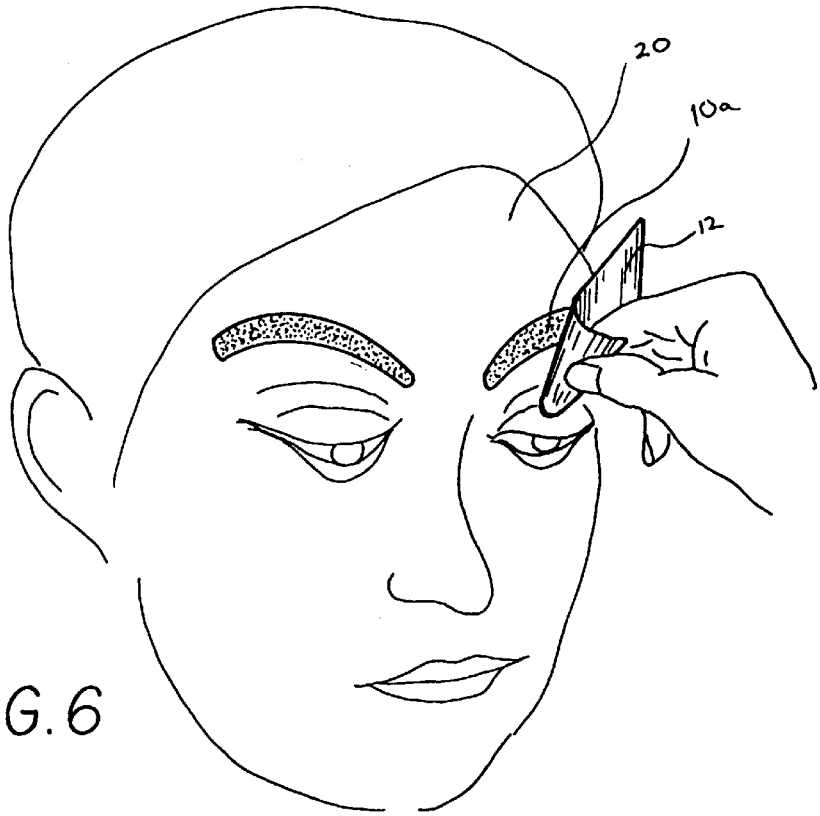
FIG. 6 is a view similar to FIG. 5, showing the tattoo eyebrow being transferred from the moisture permeable transfer sheet onto the region of the face above the left eye.

FIGS. 4–6 of the drawings disclose the application of the removable tattoo eyebrow 10*a* onto a user's face 20 over the left eye. The tattoo eyebrow 10*a* can be easily transferred onto the face 20, from the water permeable transfer sheet 12, upon the application of moisture or water to the backside of sheet 12.

As depicted in FIG. 4, the user places the removable tattoo eyebrow 10*a* on the portion of the face 20 over the left eye where an eyebrow is usually present, such that the side of the water permeable transfer sheet 12 containing the eyebrow tattoo 10*a* or the front side, is placed directly against th(e face.

As depicted in FIG. 5, the user applies a moistened sponge 54 to the back side of the water permeable transfer sheet 12, now pressed up against the face 20, for approximately 20 to 30 seconds, or an amount of time sufficient to allow for the eyebrow tattoo 10*a* to adequately adhere to the face 20.

As depicted in FIG. 6, when the water permeable transfer sheet 12 is peeled away from the face 20, the removable tattoo eyebrow 10*a* remains adhered to the face 20 over the left eye. While only one tattoo eyebrow is shown being applied to a face in FIGS. 4–6, the same transfer process can be followed if both eyebrows are to be applied at the same time.

The removable tattoo eyebrows of the present invention provide the consumer with an inexpensive and easy way of augmenting and enhancing his or her physical appearance. The removable tattoo eyebrows can be used for non-cosmetic purposes, for example, as part of a halloween costume. The removable tattoo eyebrows of the present invention can be used in any situation that requires the modification of a person's physical appearance for whatever reasons.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiments described above, but encompasses any and all embodiments within the scope of the following claims.

I claim:

1. A moisture activated, removable, tattoo eyebrow carrier sheet for cosmetically enhancing a portion of a human face where eyebrows are usually present, comprising:

a water permeable transfer sheet, at least one temporary and removable moisture activated tattoo eyebrow disposed on said water permeable transfer sheet; and and a protective release sheet removably disposed on said water permeable transfer sheet over said tattoo eyebrow for temporarily covering and protecting said eyebrow.

2. The tattoo eyebrow carrier sheet according to claim 1, wherein the at least one temporary and removable moisture activated tattoo eyebrow comprises a water soluble hypoallergenic vegetable dye.

3. The tattoo eyebrow carrier sheet according to claim 1, wherein the water permeable transfer sheet and the protective release sheet are each transparent.

4. The tattoo eyebrow carrier sheet according to claim 1, wherein said tattoo eyebrow is transferable to and temporarily adheres to the skin of a human face upon the application of water to said water permeable transfer sheet.

* * * * *